United States Patent [19]

Roche

[11] 4,226,302

[45] Oct. 7, 1980

[54] SECTIONAL LADDER LOCK

[75] Inventor: John N. Roche, Greenville, Pa.

[73] Assignee: R. D. Werner Co., Inc., Greenville, Pa.

[21] Appl. No.: 965,143

[22] Filed: Nov. 30, 1978

[51] Int. Cl.[2] ..... E06C 1/10

[52] U.S. Cl. ..... 182/178

[58] Field of Search ..... 182/178, 211, 210, 21–24; 403/317, 330, 322, 325; 292/210, 108

[56] References Cited

U.S. PATENT DOCUMENTS

| | | | |
|---|---|---|---|
| 301,980 | 7/1884 | Gates | 182/178 |
| 303,721 | 8/1884 | Gates | 182/178 |
| 337,640 | 3/1886 | Warner | 182/178 |
| 550,175 | 11/1895 | Holden | 182/178 |
| 1,263,358 | 4/1918 | Anderson | 292/210 |
| 2,610,875 | 9/1952 | Wheelden | 403/322 |
| 2,900,041 | 8/1959 | Leavitt | 182/178 |
| 3,347,584 | 10/1967 | Johnstone | 292/210 |

FOREIGN PATENT DOCUMENTS

| | | | |
|---|---|---|---|
| 810055 | 3/1959 | United Kingdom | 182/178 |

*Primary Examiner*—Reinaldo P. Machado
*Attorney, Agent, or Firm*—J. Helen Slough

[57] ABSTRACT

There is disclosed herein a sectional ladder having at least a pair of ladder sections adapted to be slideably moved relative to the other for extension or retraction, one section carrying means adapted to engage a latch mounted on the other section for automatically locking the separate sections together in a selected locked position.

16 Claims, 13 Drawing Figures

SECTIONAL LADDER LOCK

This invention relates to ladders, and in particular to locks or latches for controlling the extension and retraction of sections of so-termed sectional ladders.

Sectional ladders are ladders comprising two or more ladder sections which sections are adapted to be secured together in a preferred adjusted position, the potential ladder length being determined by the length, number and adjustment of the respective sections. Sectional ladders are often used by window washers who must reach elevated windows, and these ladders are sometimes referred to as window cleaner's ladders. Another common use of sectional ladders is to enable workmen to descend into manholes.

Since the sections of sectional ladders are frequently from 4 to 8 feet in length, and since it is common to connect three such sections together to form a ladder of 20 or 21 feet length, it is important to the safety of the person using the sectional ladder that the sections, when connected, be securely locked in place to prevent them from buckling or becoming disconnected. Likewise, it is important that, when the respective sections are connected together, the locking means not be susceptible to accidental release such as by the user of the ladder or a passerby inadvertantly striking the release mechanism.

Although it is crucial that the foregoing ladder sections be securely locked together when the sections are connected end-to-end, it is important to the user that the latch or locking means be susceptible of fast and easy (but not inadvertant) operation.

Prior locking devices for sectional ladders suffer from various deficiencies relating to the secureness of their locking condition, or to their ease of locking and unlocking the respective ladder sections. For example, one type of sectional ladder consists of ladder sections having cooperating slots in the side rails at the top and bottom of the base and upper sections, respectively, and in both ends of the intermediate sections through which uppermost rungs of the bottom and intermediate sections extend. When the sections are to be connected, an extended part of one of the uppermost rungs of a respective lower section is inserted in slots provided in the lowermost end of the opposite rails of an adjacent ladder section, so that rungs from one section are engaged in slots provided in the bottom of another section at every juncture of the separate sections. This slotted rail and rung connection exemplifies the simplest form of sectional ladder referred to above. In ladders of this type, if lateral movement occurs between the adjacent sections, the sections could conceivably slip from their slot seating causing the ladder to collapse. Moreover, if sufficient upward or downward force is exerted on the sections the same would tend to separate and the only resistence to such separation would be the weight of the ladder, there being no lock in such construction.

In another type of sectional ladder which has been characterized as an improvement over the preceding described sectional ladder, wing nuts are used to assure the retention of rung extensions in one section in the slots of the rails of an adjacent section. Although such devices would appear to assure the seating of the rung extensions in their respective slots, the manual tightening or loosening of the connecting means to connect or disconnect the ladder sections is a time consuming inconvenience, and the wing nuts tend to loosen in use.

Another type of sectional ladder is known wherein rotatable spring clips are provided near the slotted end of each side rail of a ladder section to which another section is to be connected. In use the clips must be manually forced from their locked position requiring considerable force and involving simultaneous opening of a pair of clips on either side of the ladder with the risk that an upper section will fall freely when released unless a second person is present to restrain the fall of the upper section. Also, such spring clips are subject to fatigue failure at their place of bending. Besides, spring clips could fail in their locking function if a locked upper section had a heavy load (such as a heavy person, or a person carrying a load) or were subjected to impact. In view of the serious injury which could occur upon failure of spring clips as locking devices, they are not satisfactory.

The present invention provides an improved, easily operable locking device for sectional ladders which securely fastens sections of such ladders together.

It is an object of the invention to provide an improved locking device for sectional ladders which is safe, easy to operate, secure in use and not susceptible to accidental release, when locked.

A further object is the provision of the foregoing type of sectional ladder locking device which automatically locks when the sections are assembled.

Yet another object is the provision of a sectional ladder locking device which is sturdy in construction, efficient in use and which can be manufactured economically.

Other objects of the invention and the invention itself will become more readily apparent from the accompanying description taken in connection with the drawings hereof and from the appended claims.

The preferred embodiment of the invention as shown provides a sectional ladder lock or latch comprising a latching device carried by a ladder section for receiving a protruding pin, rung or other element carried by another section wherefor adjacent ladder sections may be automatically secured together, and a releasing device for easily unlocking such connected sections only when such unlocking is intended.

In accordance with a first preferred embodiment of the invention described below, a sectional ladder lock includes a latching mechanism on each rail of the upper part of ladder sections for automatically receiving latch actuating means such as pins rigidly mounted on and extending from the inner sides of the bases of side rails of a ladder section to be mounted on the first ladder section, the latching mechanisms and pins cooperating with slots and a rung of connected portions of the ladder sections to effect a secure and rigid connection of the adjacent sections. A second, alternate embodiment differs from the first in essential form only insofar as the structural orientation of the latching members and cooperating pins is reversed; with the former located at lower end of an upper section and the latter at the upper end of a lower section. The preferred embodiments further include an easily actuable release means for unlocking latched sections, such release means being so constructed as to prevent the unintentional actuation thereof.

Figure 1:
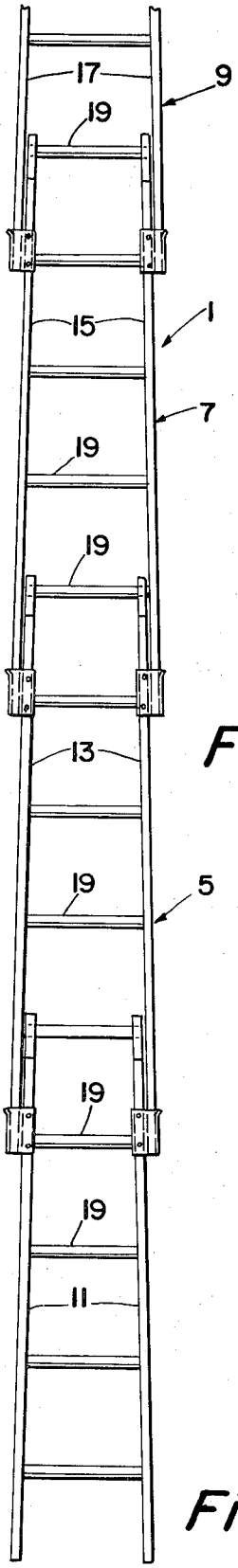
FIG. 1 is a front, partial view of an assembled sectional ladder incorporating the present invention.

Turning now to the drawings, there is depicted in FIG. 1 a sectional ladder 1 comprising a base ladder section 3, intermediate sections 5 and 7, and a top section 9. The sections are comprised of pairs of side rails 11, 13, 15 and 17, respectively. The side rails are preferably constructed from extruded aluminum, or in the case of an electrical linesman's ladder as illustrated, of fiberglass. However, other materials such as wood could be used. Rungs, designated generally as 19, extend between and are securely fastened to the respective side rails. Rungs 19 can conveniently be made from extruded aluminum tubing and can have any of the known configurations. Since the side rails are made of fiberglass, brackets 21 are appropriate rung connectors. Brackets 21 each comprise a channel shaped member, preferably made from am aluminum extrusion, having an opening for receiving an end of a rung 19, and holes through which rivets can secure the bracket to the side rail. The rungs can be secured by various cold forming operations, with connectors or the like. The side rails of the respective sections are in an opposing, slightly converging relationship, and the base portions are spaced further apart than the respective top portions. The spacing of the side rails of the respective sections is selected so that the upper part of a lower section can be received between the lower portion of an upper section to provide for the coupling of the sections as discussed below.

The respective sections are interconnected in essentially an end-to-end relationship, with connected ends overlapping by a distance equal to the distance between the end of each respective section and the rung closest thereto. The respective sections are attached by locking devices according to the invention in conjunction with cooperating rungs and side rail slots or grooves.

The bottom end of each ladder section capable of connection to a lower section (i.e., all but the base section) is provided with opposing rigid pins extending inwardly near the lowermost portion of the respective sidewalls for locking engagement with a latching mechanism of an adjacent ladder section. Thus in FIGS. 2–7, ladder section 7 is provided with latch actuating means in the form of a pair of opposing pins or pivot studs 23 which are secured in brackets or pivot plates 25, the latter in turn being fastened to side rails 15 near the lowermost portion of section 7, by rivets, bolts or other sufficiently strong fasteners 27. Pins 23 extend inwardly from side rails 15. As shown most clearly in FIG. 4, each pin can comprise a steel dowel having an inwardly facing (i.e., facing the other rail) end portion 29 of relatively large diameter and an outer end portion 31 of narrower diameter. Pin portion 29 has at its end a screw driver slot 33, and the narrow pin portion 31 is threaded for receiving a nut 35. Brackets 25 have holes 36 for receiving the smaller outer portions 31 of pins 23, but the diameter of each pin receiving hole is smaller than the outer diameter of the larger pin portion. Pins 23 are firmly secured to brackets 35 by the tightening of nuts 35 on the threaded narrow portion of the respective pins to force the shoulder between the large and narrow pin sections into firm, abutting engagement with the inner surface of the respective brackets 25. A screwdriver inserted in slot 33 of each pin 23 assists in turning the nut relative to the pin. Each ladder section other than base section 3 has a pair of similar pin assemblies near its lowermost end portion. The respective opposing pairs of pins are spaced below the lower rung in each section by a distance equal to the distance between the respective adjacent rungs of the ladder sections so that, in conjunction with the other coupling means, the ladder sections can be attached to form a single ladder structure with evenly spaced rungs.

A pair of latch devices is provided at the upper part of each ladder section to which an upper section is to be coupled for receiving in releasable locking engagement, the pins at the lower part of such upper section. Thus, referring to FIGS. 2–7 and especially FIG. 2, ladder section 5 has latching devices or mechanisms or lock housing assemblies 37 mounted on side rails 13 near the upper rung 19 of section 5. The two latching devices of each section are of identical construction, and their component parts have been ascribed like reference numerals. Thus each mechanism 37 comprises housing 39 having a partition 41 dividing the housing into a guide portion 43 and an inner or mounting portion 45. Partition 41 has a first receptacle in the form of a centrally located vertical slot 47 whose upper portion is defined by downwardly converging edges 49, and whose lower portion is wide enough to receive a pin 23 in sliding engagement. The inner portion 45 of housing 39 has U-shaped walls 51 (FIG. 7) in which are received lateral side rail walls 53; housing 39 and latch assembly 37 are mounted on side rails 15 by means of rivets or other appropriate fasteners 55 which extend through aligned holes 56, 57 in housing 39 and the side rail. Partition 41 has inwardly bent upper tabs 59 to guide the side rail of an upper ladder section into guide portion 43. The outer part of guide portion 43 is defined by co-planar vertical walls 61 having folded tabs 63 which cooperate with tabs 59 in guiding a side rail into guide portion 43. Lateral, parallel side walls 65 define the remaining sides of lock housing portions 43 and 45, and in particular cooperate with partition 41 and walls 63 to define a guide channel for receiving the side rail of the upper ladder section. Housing 39 can conveniently be fabricated by extruding aluminum through appropriate dies.

Figure 6:
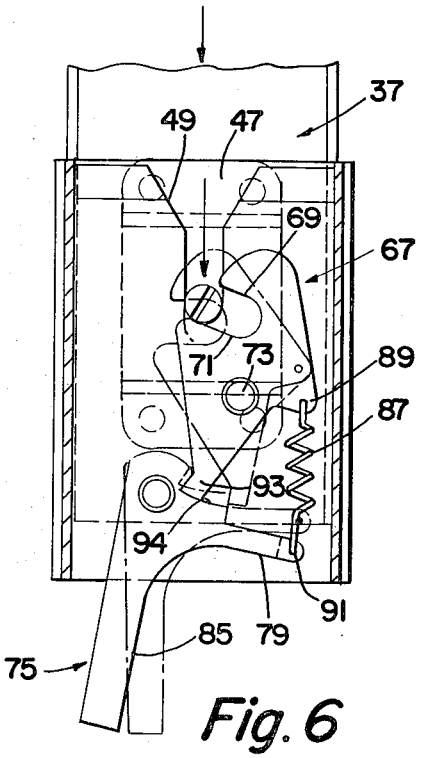
FIG. 6 is a detailed side view of ladder rails incorporating apparatus according to the invention in both locking and unlocking conditions.

As shown most clearly in FIG. 6, latching mechanism 37 is composed of a latching means, hook, lever or lock 67 having a second receptacle in the form of a slot 69 dimensioned to receive a pin 23 and being defined in part by a lower edge 71. Latching hook 67 is mounted for pivotal movement on an axle 73, which can take the form of a rivet extending through appropriate holes in hook 67 and partition 41 of housing 39, with conventional washers around the holes and abutting the opposite faces of partition 41. Latching mechanism 37 further comprises a tripping or release lever 75 which is pivotally mounted on an axle 77 of the same construction as axle 73. Lever 75 further includes an arm 79 having on its upper portion a blocking means such as first generally vertical shoulders or abutment surfaces 81, and a second shoulder 83, respectively, and a manually accessible handle 85. A biasing means shown as an extension spring 87 interconnects latching hook 67 and tripping lever 75 by virtue of its attachment to these elements at holes 89 and 91 respectively.

Figure 5:
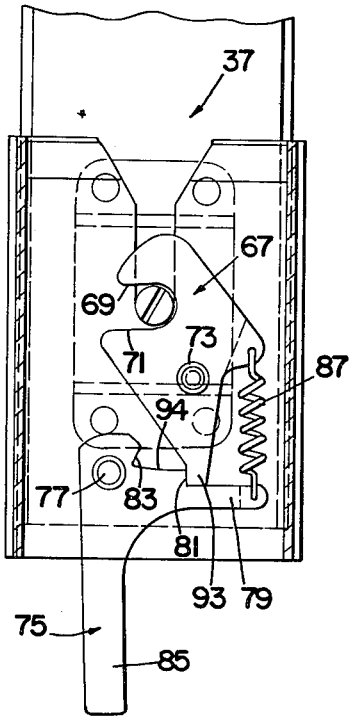
FIG. 5 is a view taken in the direction 5—5 indicated in FIG. 4.
Figure 7:
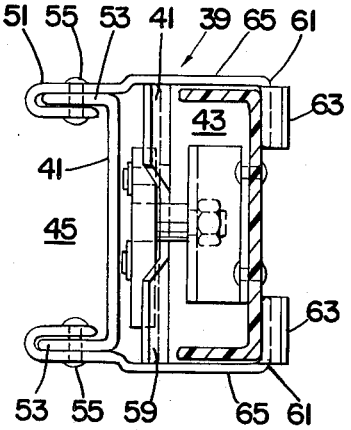
FIG. 7 is a view taken from the line 7—7 of FIG. 4.

As shown best in FIGS. 5 and 7, latching hook 67 is movable between the locking position shown in FIG. 5 and in phantom in FIG. 6, in which slot 69 is transverse to and in overlapping relation with slot 47 in partition 41 of the latching device, and the unlocking position shown by the solid lines in FIG. 6. When in the locked position, a closed compartment is defined in which a pin 23 can be trapped. When hook 67 is in its locked position, a detent 93 on hook 67 abuts against shoulder 81 of release lever 75, and spring 87 is in a relaxed state. When hook 67 is in its unlocked position, slots 47 and 69 do not intersect, detent 93 is in engagement with shoulder 83 of release lever 75, and spring 87 is in a relaxed state. Members 67 and 75 can be manufactured by stamping aluminum sheet or by various cutting techniques.

Figure 2:
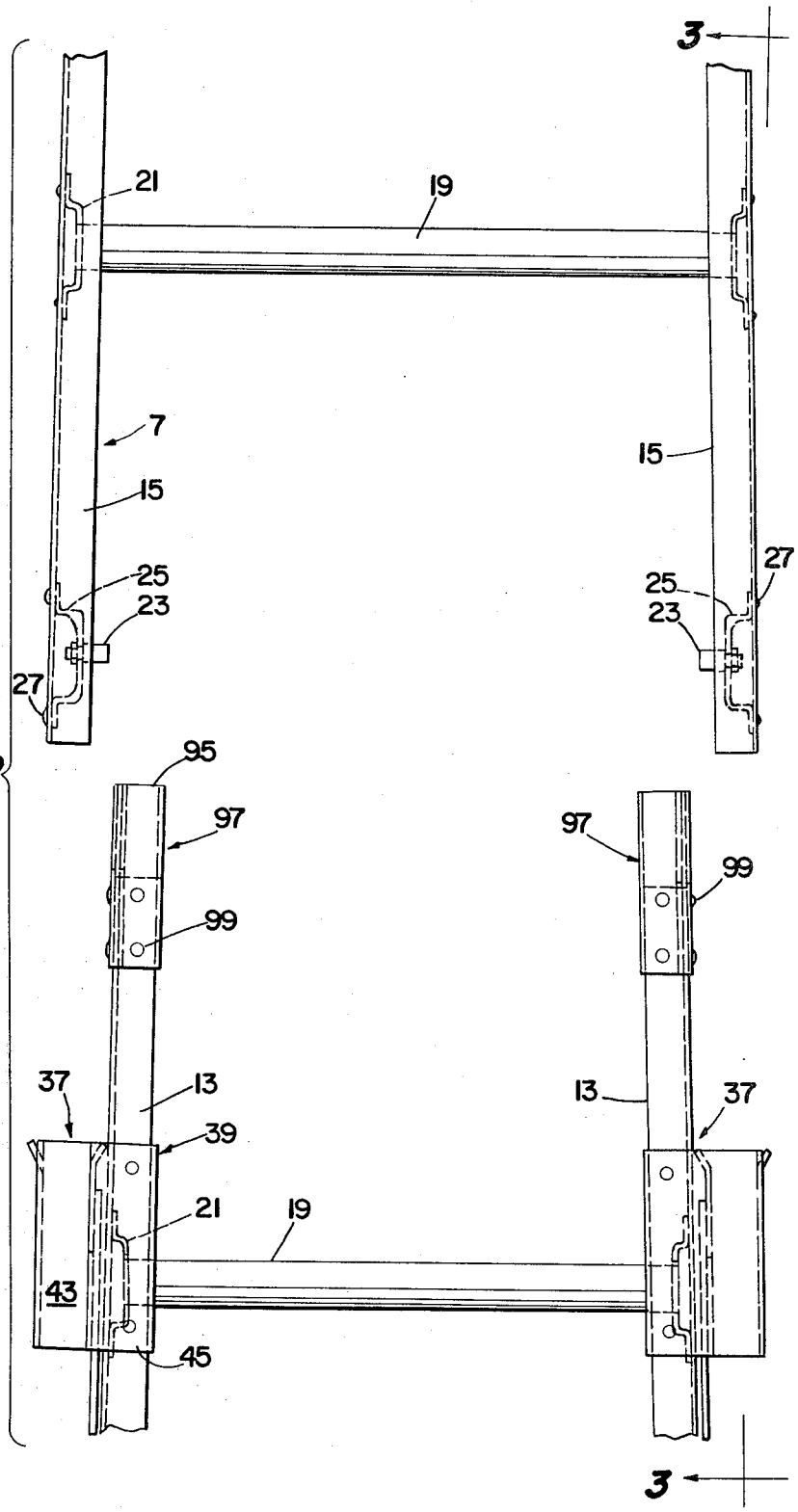
FIG. 2 is a detailed front, fragmentary view of sectional ladder sections showing apparatus according to the invention.
Figure 3:
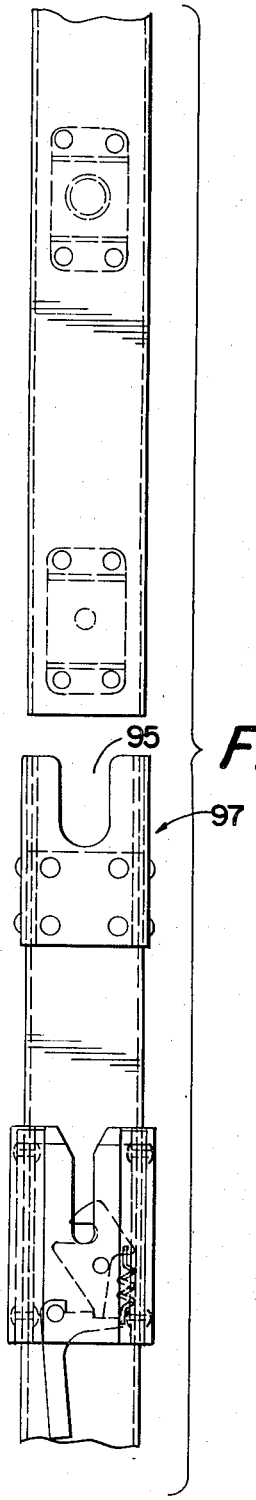
FIG. 3 is a view taken in the direction 3—3 in FIG. 2.
Figure 4:
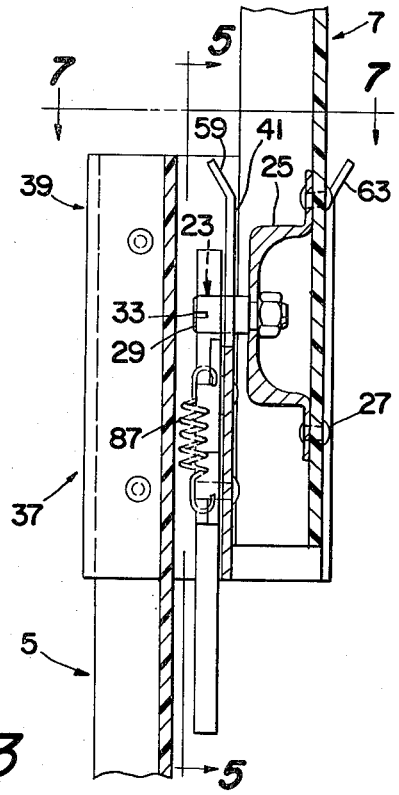
FIG. 4 is a detailed, cross-sectional side view of apparatus according to the invention in the locking condition.

The upper end of the side rails of each ladder section on which another section is to be mounted, includes slots for receiving the lower rung of the upper ladder section. Referring to FIGS. 2 and 3, lateral slots 95 are defined in the top of rails 13 of section 7 for receiving the bottom rungs 19 of section 7. Since rails 13 are made from fiberglass in the ladder shown, slots 95 are defined in opposite side walls of a metal rail shield assembly 97 which is secured to rails 13 by rivets or other fasteners 99. For other types of ladders, the foregoing slots could be defined in the side rail itself or be formed in some other manner.

In order to assemble sections 3, 5, 7 and 9 or any adjacent sections, one need only drop the bottoms of the side rails of an upper section into guide portions 43 of the latching mechanism 37 of a lower section. Upon this action, tabs 59 and 63 guide the upper side rails into guide portion 43 with pin 23 sliding down slot 47, while rung 19 of the upper section is entering slot 95 in the top of the lower section. As pins 23 travel down the slots of the latching mechanisms 37 on each of the side rails, each abuts lower edge 71 of slot 69 in latching hook 67. The weight of the upper section causes hook 67 to pivot counterclockwise about axle 73, causing detent 93 to disengage shoulder 83. As hook 67 pivots, detent 93 rotates a cam surface 94 of tripping means 75 counterclockwise, and as pin 23 reaches the bottom of slot 47, shoulder 81 moves into blocking engagement with detent 93. At this time, hook 67 has rotated sufficiently to cause slot 69 to overlap slot 47 to trap pin 23 in both slots. The latching mechanism is then in the locking condition shown in FIGS. 4, 5, 7 and in phantom in FIG. 6. When the mechanism is in locking condition, the ladder sections are firmly and rigidly locked together, with no possibility of the sections buckling or being separated upon the exertion of forces on the ladder (unless there were a failure of the material itself). Even if latch hook 67 had not been rotated sufficiently to lock pins 23 of the upper section in place, when the user of the ladder steps onto the upper section, his weight would drive pins 23 against hook 67 to place mechanism 37 in its locking condition.

In order to disassemble the locked ladder sections, one need merely grasp handle 85 of release lever 75 and rotate lever 75 counter-clockwise from the position shown in FIG. 5 and in phantom in FIG. 6. When release lever 75 is rotated in the foregoing manner, locking lever 67 is rotated clockwise since spring 87 pulls lever 67 in that direction; and once detent 93 clears shoulder 81 of release lever 75, spring 87 rotates hook 67 clockwise until detent 93 abuts shoulder 83. When the latter action is completed, pin 23 is no longer trapped in slots 47 and 67, and the upper ladder section can be withdrawn from the lower section to which it was connected.

The accessible part of handle 85 of release lever 75 is located just beneath housing 39 where it cannot inadvertently be moved to unlock latching hook 67. Furthermore, the unlocking of lever 67 is readily noticeable because of the sound made as detent 93 strikes shoulder 83.

Although the preferred embodiment of the invention has been described as it is used on ladder sections 5 and 7, it is contemplated that identical latching mechanisms and pin assemblies be used on all of the sections to be joined. Furthermore, pins 23 could be replaced with appropriately constructed rungs; for example, the latching mechanisms could be mounted on ladder side rails for receiving extensions of rungs extending outwardly from the side rails of the upper ladder section. In the latter case, it would be appropriate for the side rails of the lower section to be spaced sufficiently to receive between them the side rails of the upper section, and for the latching mechanisms to be mounted to extend inwardly from the interior side of the side rails. It is also within the scope of the invention for the latching mechanisms to be mounted on the upper ladder sections for receiving pins, rungs or the like attached to the lower ladder sections.

Figure 8:
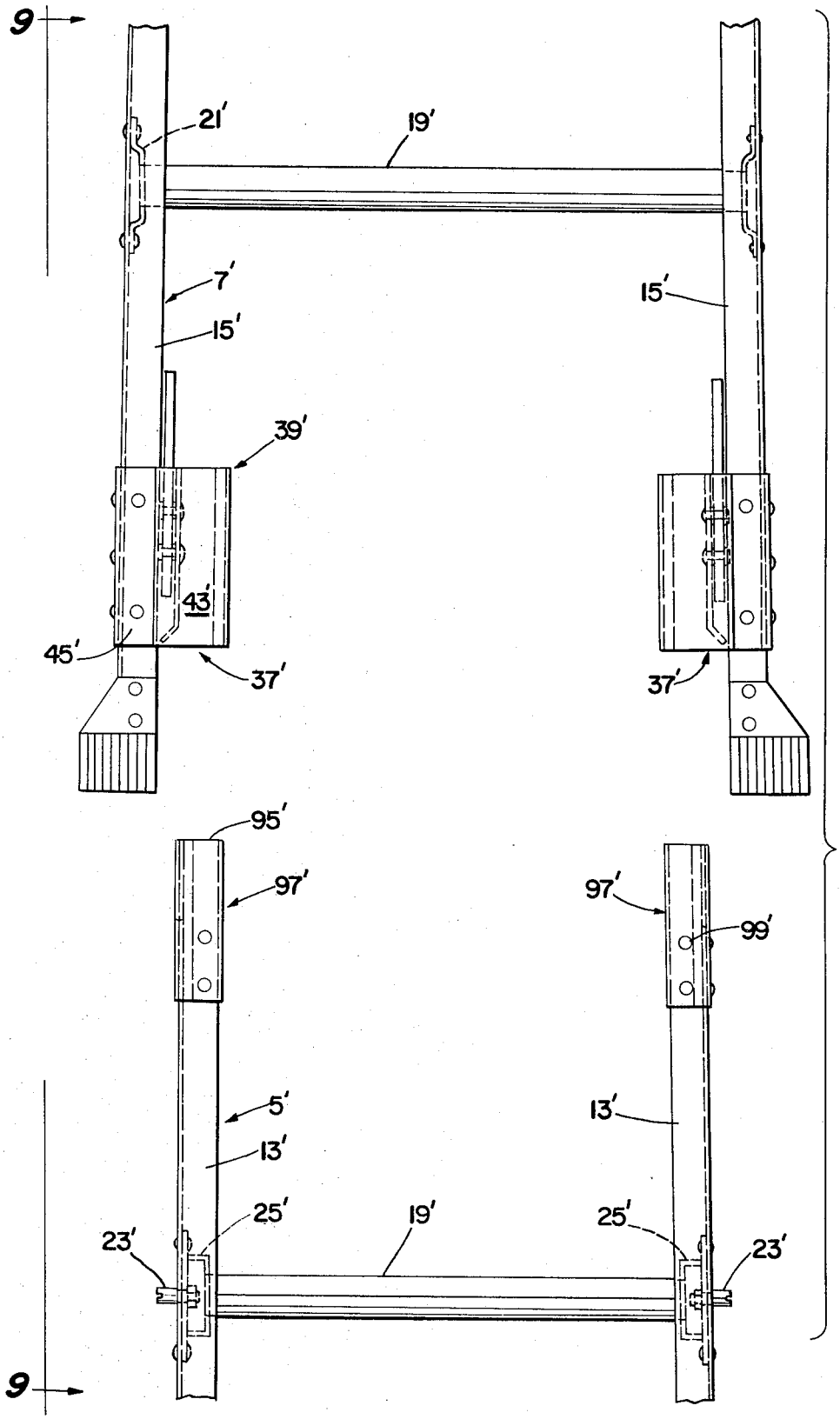
FIG. 8 is a detailed front, fragmentary view of sectional ladder sections showing apparatus according to an alternate embodiment of the invention.
Figure 9:
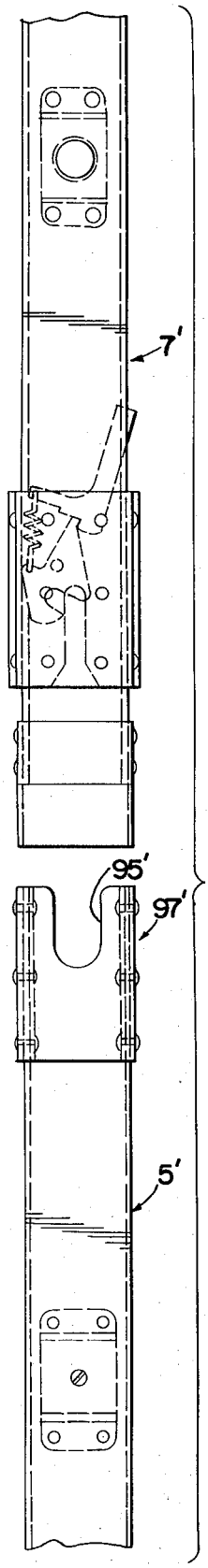
FIG. 9 is a view taken in the direction 9—9 in FIG. 8.
Figure 10:
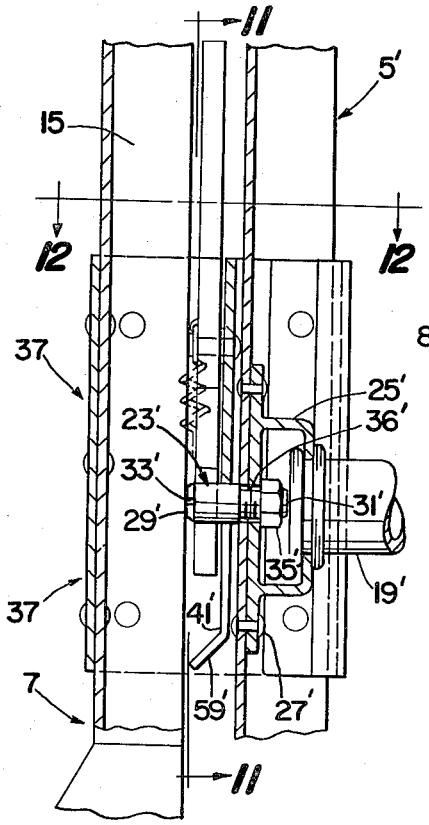
FIG. 10 is a detailed, cross-sectional side view of apparatus according to the alternate embodiment of the invention in the locking condition.
Figure 11:
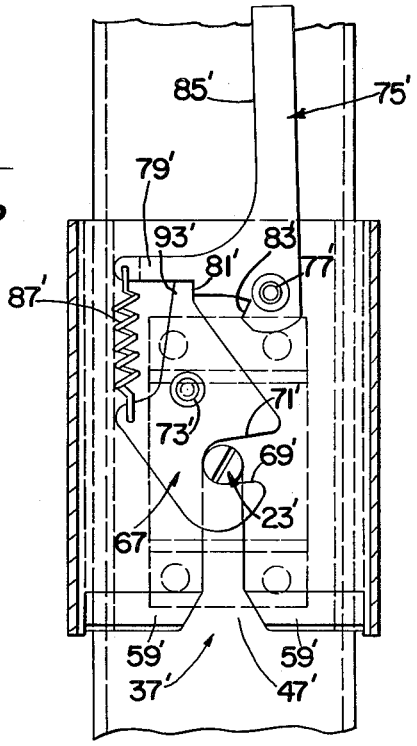
FIG. 11 is a view taken in the direction 11—11 of FIG. 10.
Figure 13:
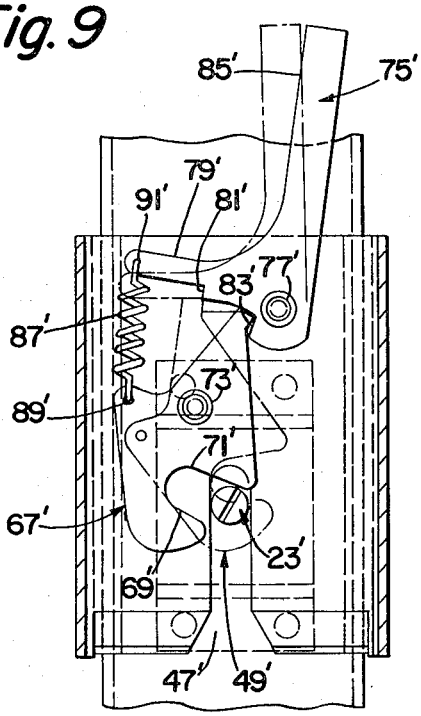
FIG. 13 is a detailed side view of ladder rails incorporating apparatus according to the alternate embodiment of the invention in both locking and unlocking conditions.
Figure 12:
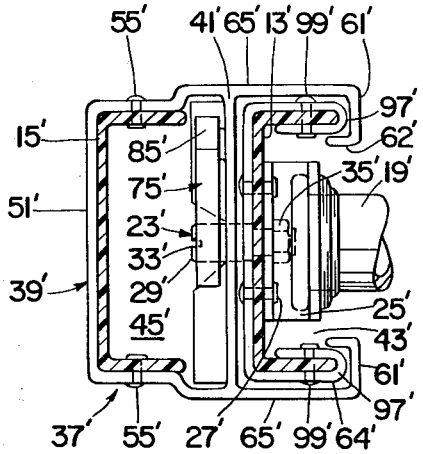
FIG. 12 is a view taken from the line 12—12 of FIG. 10.

With respect to the immediately foregoing, FIGS. 8–13 show this alternate construction where the lock or latching mechanism is provided inwardly of the side rails of an upper ladder section while the pin or post members project outwardly of the side rails of a lower ladder section. For convenience, all structure in the alternate embodiment illustrated in FIGS. 8–13 which corresponds with similar structure in the embodiment of FIGS. 1–7 is identified by primed reference numerals. For example, the side rails 15' of upper ladder section 7' in FIG. 8 are essentially the same as the side rails 15 of upper ladder section 7 in FIG. 2.

The partial assembly shown in FIG. 8 comprises a lower ladder section 5' which includes side rails 13' between which extend a plurality of rungs 19'. A pin or post 23' is located generally coincident with the uppermost rung of the section 5', and is directed outwardly of each of the side rails 13' thereof. The rungs are secured to the side rails by means of brackets 25', which also permit clearance for the nut 35' retaining post 23', as best viewed in FIGS. 8 and 12. Since the rails 13' are made from fiberglass in the ladder shown, a metal shield assembly 97' secured to the rails by rivets or other fasteners 99', is provided at each of the upper ends thereof.

The upper ladder section 7', as shown in FIG. 8, similarly includes side rails 15' and interconnecting rungs 19'. Located on the inner sides of the side rails 15' at the lower end of the section 7' are a pair of latching devices 37' for cooperation with the pins or posts 23' in the same manner as described above with reference to FIGS. 1–7. The only difference in the embodiment of FIGS. 8–13 resides in the reverse orientation of the components. Along these lines, the most significant departure is the structural arrangement of the mechanism 37' with respect to the side rails 15', which is best viewed in FIG. 12.

Each of the mechanisms 37' comprises a housing 39' having a partition 41' dividing the housing into a guide portion 43' and a mounting portion 45'. The mounting portion 45' has a U-shaped end wall 51' substantially contiguous with the side rail 15', to which the mechanism is secured by fasteners, such as rivets 55'. The outer part of guide portion 43' is defined by coplanar vertical walls 61' which terminate at inturned lips 62 to yield a guideway or slot 64 within which the rails 13' may move. Lateral, parallel side walls 65' define the remaining sides of lock housing portions 43' and 45'. Otherwise, the structure of mechanism 37' and its cooperative function with posts 23' are identical to that described above with reference to the embodiment of FIGS. 1–7.

The embodiments described above achieve the various objects of this invention. An improved locking device has been provided for securely fastening the sections of sectional ladders together. The apparatus is safe, easy to operate while being unsusceptible to inadvertant operation. The apparatus is automatically placed in its locking mode when two sections are joined. The apparatus can be manufactured economically using conventional manufacturing techniques.

The invention has been described in detail with particular attention to the preferred embodiment thereof, but it should be understood that variations and modifications within the spirit and scope of the invention may occur to those skilled in the art to which the invention pertains.

I claim:

1. Apparatus for releasably locking a ladder section to another ladder section, said ladder sections being movable relative to each other, and latch actuating means protruding from one of said ladder sections and being movable with said one ladder section; and a latching mechanism mounted on the other of said ladder sections, said latching mechanism including:

a latching hook for securing said other ladder section to said one ladder section, said latching hook being movable between a locking position wherein a portion of said hook is disposed in the path of movement of said latch actuating means to releasably lock said ladder members together and a releasing position wherein said one ladder member is removable from said other ladder member; and tripping means operable in response to the movement of said latching hook to the locking position to prevent movement of said hook from the locking position, and manually operable for enabling the movement of said locking means from the locking position to the releasing position.

2. The invention according to claim 1 and further including biasing means for biasing said latching hook towards said releasing position in response to the manual operation of said tripping means.

3. The invention according to claim 1 wherein said ladder sections each comprise a pair of side rails and wherein said latching mechanism further comprises guide means having a first receptacle for receiving said latch actuating means; and said latching hook includes a second receptacle for receiving said latch actuating means, said first and second receptacles cooperating simultaneously to trap said latch actuating means in both receptacles when said latching hook is in the locking position.

4. The invention according to claim 3 wherein said first receptacle comprises a first slot in said guide means and said second receptacle comprises a slot in said latching hook, and said latching hook further includes an engagement surface overlying said first slot when said latching means is in the releasing position, said engagement surface being engageable by said latch actuating means of said one ladder section to move said latching means to the locking position.

5. The invention according to claim 1 wherein said latch actuating means comprises a rigid member protruding transversely from at least one of said side rails.

6. The invention according to claim 5 wherein said apparatus further includes guide means having a first slot for receiving said rigid member, and said latching hook comprises a second slot for receiving said rigid member, and pivot means for supporting the latching hook for pivotal movement relative to said guide means between the locking position wherein said first and second slots overlap to trap said rigid member therein, and the releasing position wherein said first and second slots do not trap the rigid member therein.

7. The invention according to claim 6 wherein said tripping means comprises a tripping member mounted for movement between first and second positions, said tripping member including an abutment surface for engaging said latching hook when said latching hook is in said locking position and said tripping member is in said first position, said tripping member carrying said abutment surface out of engagement with said latching hook in response to the movement of said tripping member to said second position.

8. The invention according to claim 1 wherein said ladder sections each comprise a pair of side rails, said latching hook includes a receptacle for receiving said latching actuating means and a detent engageable by said tripping means for preventing movement of said latching means from the latching position, and wherein said apparatus further includes:

spring means connected to said latching hook for biasing said latching means towards the locking position; and a housing mounted on said other ladder section; said housing including a receptacle for receiving said latch actuating means, means for guiding said latch actuating means into said first receptacle, means for mounting said latching hook for movement between the locking position wherein said latch actuating means is simultaneously received and trapped in both of said receptacles and the releasing means wherein said latch actuating means is removable from said receptacles; and means for mounting said tripping means for movement between a first position wherein said tripping means engages said detent to block said latching hook from movement from said locking position and a second position wherein said tripping is disabled from blocking movement of said latching hook from said locking position.

9. The invention according to claim 8 wherein said tripping means comprises a manually actuable lever, and said spring means interconnects said latching hook and said tripping means, said spring means moving said latching hook to the releasing position in response to the movement of said lever to said second position.

10. The invention according to claim 9 wherein said lever comprises a handle located adjacent said housing for preventing the inadvertent actuation thereof.

11. The invention according to claim 8 wherein said receptacles in said latching hook and in said housing comprise slots for receiving said latch actuating means.

12. The invention according to claim 11 wherein said slot in said latching hook is transverse to the slot in said housing when said latching hook is in the locking position to define a closed compartment for holding said latch actuating means, and wherein said latching hook is engageable by said latch actuating means when said latching means is in the releasing position, said latch actuating means being movable in said slots simultaneously while in engagement with said latching hook to move said latching hook to the locking position.

13. The invention according to any of claims 1, 2, 3, 5 or 8 wherein said one ladder section includes opposing side rails interconnected by generally parallel rungs and said latch actuating means comprises at least one pin parallel with said rungs and protruding from at least one of said side rails.

14. The invention according to any of claims 1, 2, 3, 5 or 8 wherein said latching mechanism further includes guide means for guiding the side rails of said one ladder section along the guide rails of said other ladder section, to guide said latch actuating means into operative engagement with said latching hook.

15. The invention according to claim 1 wherein said ladder sections have upper and lower end portions, and said latch actuating means are mounted at the lower end portion of said one ladder section and each of said latching mechanisms is mounted at the upper end portion of said other ladder section.

16. The invention according to claim 15 wherein said apparatus further includes slot means in the ends of the side rails of one of said ladder sections for engaging a rung of the other of said ladder sections, for cooperating with said latch actuating means and said latching mechanism in releasably locking said ladder sections together.

* * * * *